United States Patent [19]

Hall

[11] Patent Number: 4,866,964

[45] Date of Patent: Sep. 19, 1989

[54] REMOVABLE CORE LOCK

[75] Inventor: Charles E. Hall, Salem, Va.

[73] Assignee: Medeco Security Locks, Inc., Salem, Va.

[21] Appl. No.: 291,660

[22] Filed: Dec. 28, 1988

[51] Int. Cl.[4] ..... E05B 27/00

[52] U.S. Cl. ..... 70/369

[58] Field of Search ..... 70/369, 367, 328, 370, 70/371, 375, 373

[56] References Cited

U.S. PATENT DOCUMENTS 2,000,829 5/1935 Falk ..... 70/369

2,027,186 1/1936 Lowe ..... 70/369

2,059,695 11/1936 Jacobi ..... 70/369

2,059,698 11/1936 Jacobi ..... 70/369

*Primary Examiner*—Robert L. Wolfe

*Attorney, Agent, or Firm*—Bernard, Rothwell & Brown

[57] ABSTRACT

A removable core cam lock of the type having a key operated core within a shell, is provided with a spring clip controlled by a core removal key which is longer than an operating key. The spring clip fits in a groove in the core and extends through a slot in the shell so that when the core removal key is put into the lock it operates the lock and on rotation of the lock it lifts the spring clip to allow core removal.

3 Claims, 1 Drawing Sheet

REMOVABLE CORE LOCK

BACKGROUND OF THE INVENTION

1. Field Of The Invention

This invention relates to improvements in removable core locks and particularly to a removable core lock and key assembly utilizing a unique key operated spring clip holding arrangement for controlling removability of the core.

2. Background Art

Removable core locks are well known in the art and are highly desirable in that they allow changing of locks (and keys) by merely removing the core or plug of the lock, and replacing it with another core operable by another key. The art on removable core locks is well worked as shown, for example, see U.S. Pat. Nos. 463,457, 4,484,462, 4,191,037, 4,123,926, 4,672,827, 4,761,978 4,712,400, and 4,715,201, as well as a prior patent to applicant's assignee, Medeco Security Locks Inc., U.S. Pat. No. RE 31,910.

Even though the art on removable core locks is well worked, there is still room for improvements particularly for a removable core lock that is simple to operate, inexpensive to manufacture, utilizes a movable core control key which has the same bitting as the operation key but is recognizable as a control key, and which has increased pull resistance to force if an attempt were made to "pull" the plug.

SUMMARY OF THIS INVENTION

This invention relates to an improved removable core cylinder lock of the type having a plug or core rotatable in a lock shell but removable therefrom, in which there is a spring clip carried by the shell and cooperating with a groove in the core for normally retaining the core against removability, the spring clip being movable to allow core removal by a control key having the same bitting as an operation key but being longer so when the properly bitted control key is inserted to the core, the core is rotated until the key raises the spring clip out of the groove to allow the core to be axially removed from the shell.

DETAILED DESCRIPTION OF PREFERRED EMBODIMENT

Figure 1:
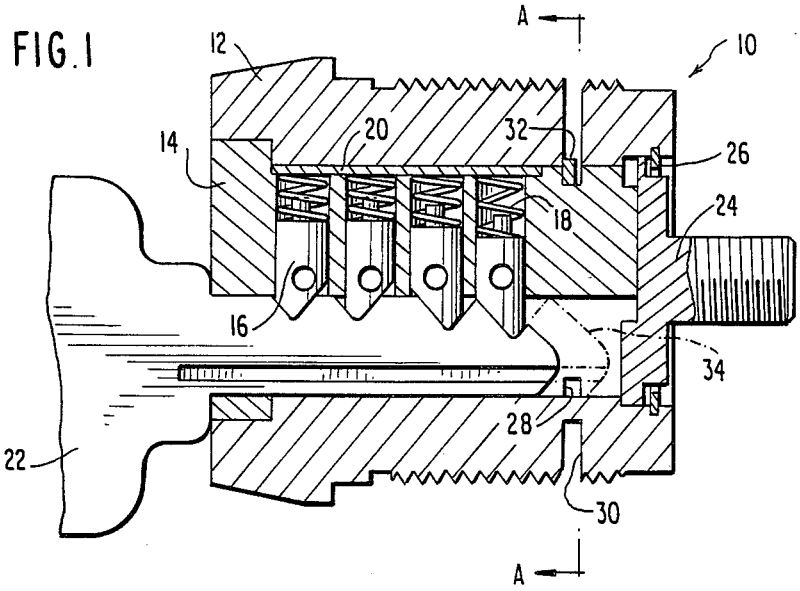
FIG. 1 is a side sectional elevation view of the removable core lock of this invention, showing the lock with an operation key and showing a control key therein in dotted lines.

A cylinder lock and key shown in section in FIG. 1. The cylinder lock may, for example, be of the type shown in U.S. Pat. No. 3,722,240, granted Mar. 27, 1973 and such lock is known on the market as a "cam lock" manufactured by Medeco Security Locks Inc. A removable core lock 10 has a hollow shell 12 which carries a removable core 14. As is conventional, the core 14 has a plurality of tumblers 16 which are biased by tumbler springs 18 which in turn are retained by retainer 20 as is known in the art. Not shown in FIG. 1 but as is well known the tumblers operate to control a fence (see Medeco U.S. Pat. No. 3,722,240) which cooperates with a groove in the shell to allow the plug to turn under control of a properly bitted key, however, any other tumbler operating mechanism would also be within the scope of this invention which is not limited to the lock operating mechanism but is directed to the removability of the lock core.

An operating key 22 which may have a suitable grooved keyway is properly bitted to control operation of the tumblers. As shown in FIG. 1 the axis of the tumblers is offset from the center of the bits in the manner described in Medeco U.S. Pat. No. 4,635,455 and is known in the art by virtue of the lock sold by Medeco Security Locks, Inc. under the mark BIAXIAL®. Such operating mechanism is, however, not an essential of this invention, which, as mentioned above relates to removability of the core.

As shown in FIG. 1 a tailpiece 24 is retained in the end of the hollow shell by a retaining ring 26. Although a screw-type tailpiece is shown, any other suitable operating mechanism such as a lever, cam, switch operator or the like may be used as the mechanism for transmitting the motion of the lock core or plug to the operated mechanism.

The lock so far described is of the type previously known. The improvements for allowing removability of the core include a slot 30 formed in the shell, the slot being for the purpose of retaining a spring clip 32. The slot 30 extends completely through a portion of the shell so as to be in communication with a circumferential groove 28 formed in the periphery of the core at the end of the core which is inserted into the plug and beyond the first tumbler position.

Figure 2:
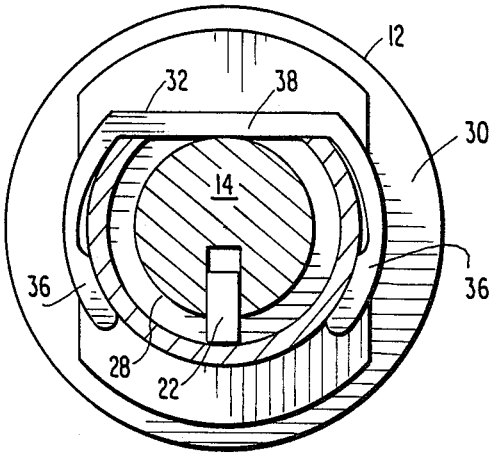
FIG. 2 is a sectional view taken along the line A—A of FIG. 1 showing the assembly in locked position with an operation key.
Figure 3:
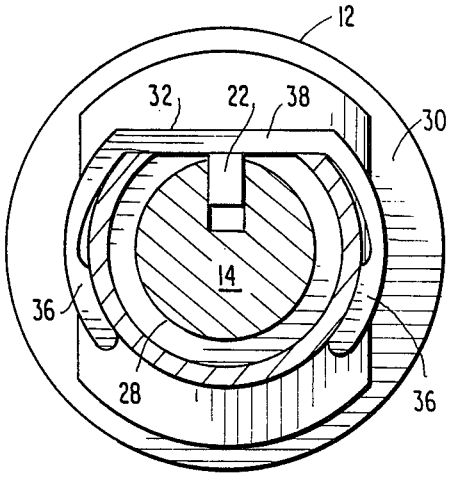
FIG. 3 is a sectional view taken along line A—A of FIG. 1 showing the assembly in unlocked position with an operation key.
Figure 4:
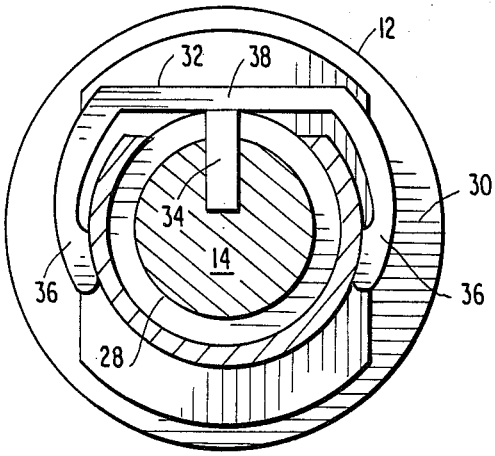
FIG. 4 is a sectional view taken along line A—A of FIG. 1 showing the assembly in core removal position with the core removal key which has raised the spring clip normally retaining the core.

As shown in FIGS. 1–4 the spring clip 32 is generally C-shaped and has a pair of legs 36 separated by a straight portion 38, the legs grip the bottom of the slot 30 of the cylindrical shell 12 and the flat portion 38 fits into the groove 28 tangential to the bottom of the groove as shown in FIGS. 2–4.

A core removal key, or control key, 34 is shown in dotted lines in FIG. 1 and such key has the same bitting as the operating key 22 but is longer to an extent that the blade of key 34 extends beyond the groove 28 so as to contact the spring clip 32 when the core removal key is utilized.

In operation, the lock operates as a normal cylinder lock when using the operating key 22. FIG. 2 shows the assembly in locked position with the operating key in it. Rotating the operating key a predetermined amount, e.g., 180° in the embodiment shown, will move the assembly to unlocked position while the plug is still retained in its innermost position by the spring clip 32.

If it is desired to remove the core the core removal key 34 is inserted into the lock and it has the same bitting so as to properly operate the tumblers and allow the core or plug to be rotated as shown in FIG. 4. On rotation of the key 34 and core 14 180° the back of the key blade will contact the straight portion 38 of clip 32 and raise it above circumferential groove 28. The periphery of the cylindrical plug is the shear line and with the spring clip 32 removed from groove 28 the core may be pulled out of the lock and a new core may be placed therein. To place the new core in the lock the same operation is repeated in reverse using the core removal key. After the new core is in the lock the core removal key is removed and the core will remain in the lock until it is desired to change the core again using the core removal key as described.

The lock of the present invention provides superior resistance to pulling, is simple, easy and inexpensive to manufacture and is easy to operate.

I claim:

1. A removable core lock assembly comprising:

(a) a hollow shell member, the shell member having a configuration to receive a spring clip means;

(b) a removable core slidable axially into and out of the shell member, the removable core having a circumferential groove adjacent its end within the shell;

(c) a plurality of pin tumblers within the core, the pin tumblers being operable by a properly bitted operation key;

(d) spring clip means in the form of a generally C-shaped spring clip carried by the shell and having a portion fitting into the groove in the core for normally retaining the core against axial movement in the shell, the spring clip means being movable to allow core withdrawal by a control key being longer than an operation key to engage the spring clip means and raise the same from the groove when the core is rotated by the control key, wherein the central portion of the spring clip has a flat side which is tangential to the bottom of the circumferential groove on the core.

2. A removable core cam lock of the type having a hollow shell, a removable core positionable within the hollow shell and having a plurality of tumblers operable with a properly bitted operation key, and further control key for removing the core, with improvements comprising:

(a) a circumferential groove adjacent the end of the removable core within the shell;

(b) a slot extending through the shell and communicating with at least a portion of the groove;

(c) a spring clip carried by the shell, extending through the slot, and normally cooperating with the groove to prevent axial movement of the core, the core being removable by raising the spring clip from the groove by means of a control key on rotation of the plug, the control key being longer than the operation key, wherein the spring clip has a portion thereof which contacts the bottom of the circumferential groove in a tangential manner.

3. A removable core cam lock and key assembly comprising:

(a) a hollow shell, the shell having a slot therein;

(b) a removable core slidable axially into and out of the shell and rotatable therein, the removable core having a circumferential groove adjacent an inner end thereof inside the shell;

(c) a plurality of pin tumblers within the core for allowing the core to rotate when the pin tumblers align with the shear line;

(d) a properly bitted operation key for operating the pin tumblers and the lock;

(e) a spring clip carried by the slot in the shell and cooperating with the groove in the core for normally retaining the core against axial movement in the shell;

(f) a core removal key having the same bitting as the properly bitted operation key but being longer so as to extend into the core at least to the depth of the groove so that by rotating the core under the properly bitted core removal key the spring clip is raised from the groove to the shear line to allow the core to be removed.

* * * * *